US010662604B2

(12) United States Patent
Wood

(10) Patent No.: US 10,662,604 B2
(45) Date of Patent: May 26, 2020

(54) PROP

(71) Applicant: EZE Shoring (Halifax) Limited, Leeds, Yorkshire (GB)

(72) Inventor: Glenn Roy Wood, Keighley (GB)

(73) Assignee: EZE Shoring (Halifax) Limited, Leeds (GB)

( * ) Notice: Subject to any disclaimer, the term of this patent is extended or adjusted under 35 U.S.C. 154(b) by 0 days.

(21) Appl. No.: 16/314,821

(22) PCT Filed: Jul. 4, 2017

(86) PCT No.: PCT/GB2017/051974
§ 371 (c)(1),
(2) Date: Jan. 2, 2019

(87) PCT Pub. No.: WO2018/007806
PCT Pub. Date: Jan. 11, 2018

(65) Prior Publication Data

US 2019/0234038 A1 Aug. 1, 2019

(30) Foreign Application Priority Data

Jul. 4, 2016 (GB) ..... 1611661.8

(51) Int. Cl.
*E02D 17/08* (2006.01)
*E04G 25/04* (2006.01)

(52) U.S. Cl.
CPC ..... *E02D 17/083* (2013.01); *E04G 25/04* (2013.01); *E02D 2300/0006* (2013.01); *E02D 2300/0017* (2013.01); *E02D 2300/0068* (2013.01)

(58) Field of Classification Search
CPC ..... E02D 17/083; E02D 2300/0006; E02D 2300/0017; E02D 2300/0068
See application file for complete search history.

(56) References Cited

U.S. PATENT DOCUMENTS 3,698,149 A * 10/1972 Baker ..... E04B 1/18 52/844
5,401,122 A * 3/1995 Pate, Jr. ..... E02D 17/08 405/133
2002/0159843 A1* 10/2002 Hubbell ..... E02D 5/24 405/231
2016/0115666 A1* 4/2016 Hargrave ..... E02D 5/14 405/274

FOREIGN PATENT DOCUMENTS

CN 201874251 U 6/2011
WO WO 2015/048513 A1 4/2015

* cited by examiner

*Primary Examiner* — Tara Mayo-Pinnock
(74) *Attorney, Agent, or Firm* — Blank Rome LLP

(57) ABSTRACT

The present disclosure relates to a prop (10) comprising a first tube (14) and a second tube (16). The first tube (14) is telescopically connected to the second tube (16) for axially displacing the second tube (16) between a retracted position and an extended position. The first and second tubes (14, 16) each comprise a loading end for receiving an axial load from opposing load surfaces (62, 64) in the extended position. The first tube (14) and the second tube (16) are made from a plastics material.

12 Claims, 3 Drawing Sheets

PROP

TECHNICAL FIELD

The subject matter of the present disclosure relates to prop supports used for construction. In particular, but not exclusively, the subject matter of the present disclosure relates to props used to brace sidewalls of a trench excavated when accessing subterranean networks.

BACKGROUND

Conventional props, also termed a "struts" or "trench struts", are made from a metallic material, such as steel, for low cost and strength reasons. Typically, a prop includes a first tube telescopically connected to a second tube. The prop is axially extendable between a retracted position, where the second tube is interior to the second tube, and a deployed position where the first and second tubes engage opposing trench walls. In this way, the prop braces the trench walls to minimize the risk of the walls collapsing.

The present disclosure provides an improved prop.

SUMMARY

According to an aspect of the present disclosure, there is provided a prop comprising a first tube and a second tube, the first tube being telescopically connected to the second tube for axially displacing the second tube between a retracted position and an extended position, the first and second tubes each comprising a loading end for receiving an axial load from respective opposing load surfaces in the extended position, wherein the first tube and the second tube are made from a plastics material.

The first and second tubes are substantially electrically non-conductive when made from a plastics material. It appears counter-intuitive to utilize a plastics material for the first and second tubes since typically props are made from steel. However, often in construction scenarios, particularly during trench excavations, electrical components, such as cables, can contact the tubes, sometimes when the cables are in a damaged state. By making the tubes electrically non-conductive, an operator is at a reduced risk of suffering an electrical injury when touching the prop. Making the first and second tubes electrically non-conductive is particularly important in comparison to other parts of the prop since an operator would hold each tube to install or remove the prop and the tubes are located in the vicinity of opposing loading surfaces when installed, from where the electrical components may be protruding so are at higher risk of contact. In addition, plastics materials are non-magnetic, which may be particularly beneficial in certain situations, for example when excavating trenches when disposing of unexploded ordnance. Further, plastics materials prevent sparks resulting from collisions with foreign objects, e.g. metal on metal collisions, and would be of particular benefit in situations such as using the prop in a gas station or an oil refinery, for example. The term "tube" is not necessarily constrained by being hollow or circular in cross-section, since load bearing members of other configurations may be used.

According to an embodiment, the prop further comprises a first foot connected to the loading end of the first tube for engaging a load surface and a second foot connected to the second tube for engaging an opposing load surface, wherein the first and second feet are made from a plastics material.

Again, making the feet from a plastics material is counter intuitive when considering existing props made exclusively from metal. However, the feet are in contact with the load surfaces, where electrical components, such as cables, may be situated. Making the feet from a plastics material further reduces the risk of an electrical injury to an operator who may contact the feet whilst working or when installing/removing the prop.

According to an embodiment, the first foot and/or the second foot comprises a base plate and a spigot extending therefrom, the spigot and the respective first tube or second tube comprising complimentary threads.

The complimentary threads enable the first and/or second feet to be removably mounted to the respective first or second tube in a way in which damage is unlikely to occur when during mounting or removal. In this way, the first and/or second feet are provided as line replaceable units. The service life of the prop may be increased since it may not be necessary to discard the prop in the event of a damaged foot. Further, feet of different shapes and sizes may be incorporated for different purposes.

According to an embodiment, the first tube and/or the second tube comprises an attachment sleeve fixed to an interior surface thereof, the attachment sleeve including the threads.

The attachment sleeve means that the threads need not be included on the tube. As a result, there is greater flexibility over the material for manufacturing the tube(s). For instance, the tube(s) may be made from fibre reinforced composite when no threads are required.

According to an embodiment, the plastics material of one or more of the first tube, the second tube, the first foot, or the second foot comprises fiber reinforcements. Fiber reinforcements increase the strength of the prop, particularly in an axial direction, which is the direction of transfer of the axial load.

According to an embodiment, the fiber reinforcements comprise carbon.

According to an embodiment, the prop further comprises a linear actuator to connect telescopically the first and second tubes, wherein the linear actuator is spaced from the loading ends of the first and second tubes when the prop is in the extended position, the first and second tubes electrically insulating the linear actuator from the respective loading ends.

Any stray electrical components penetrating a load surface would likely contact the feet or the first or second tubes as opposed to the linear actuator since the linear actuator is suspended away from the load surfaces by being spaced from the loading ends of the tubes. An operator would thus be at reduced risk of an electrical injury when contacting the linear actuator during retraction or extension since the linear actuator would be electrically insulated from the stray electrical component touching the tubes or feet. In this way, the linear actuator has greater flexibility in terms of material selection, even with the possibility of being made from a metallic material for strength reasons for transferring the axial load between the tubes.

According to an embodiment, the linear actuator comprises a threaded section associated with the first tube, a ring threadingly engaged with the threaded section, and a pin coupled to the second tube for transferring the axial load between the second tube and the ring.

The terms "ring" and "pin" may be used herein interchangeably with the terms "load ring" and "load pin", respectively, since the ring and pin transfer the axial load between the first and second tubes.

According to an embodiment, the ring comprises a handle integrally formed therewith. The handle would thus be less likely to fail when a turning moment is applied to rotate the ring.

According to an embodiment, the linear actuator comprises a sleeve attached to the first tube, the sleeve comprising the threaded section. Utilizing the sleeve as opposed to applying the threaded section directly to the first tube allows a greater degree of flexibility over material selection and manufacturing methods used for each component. For instance, cutting threads into a tube made from a fiber reinforced plastics material could result in a prop of insufficient axial strength. Other materials, such as nylon may not be degraded by the provision of threads in the same way.

According to an embodiment, the sleeve comprises an annular wall to abut an end of the first tube opposite to the loading end. The annular wall serves to provide a load transfer path for the axial load between the first tube and the sleeve. Further, the annular wall provides a fail-safe in case a bond fixing the sleeve to the first tube fails.

According to an embodiment, one or more of the sleeve, the ring, and the pin are made from a plastics material. It would be appreciated that the sleeve includes the threaded section, which in turn may also be made from a plastics material. In this way, an operator is further protected from an electrical injury in case a stray electrical component contacts the linear actuator directly when the operator is deploying or retracting the prop.

According to an embodiment, one or more of the plastics materials is a thermoplastic.

According to an embodiment, the thermoplastic is nylon. Nylon is sufficiently strong to transfer axial loads that a prop would experience in use. Nylon also allows threads to be cut into the surface and can be self-lubricating.

According to an embodiment, the axial load is transferred through the plastics material.

BRIEF DESCRIPTION OF THE FIGURES

The subject-matter of the present disclosure is described below with reference to the accompanying figures, in which.

DETAILED DESCRIPTION

Figure 1:
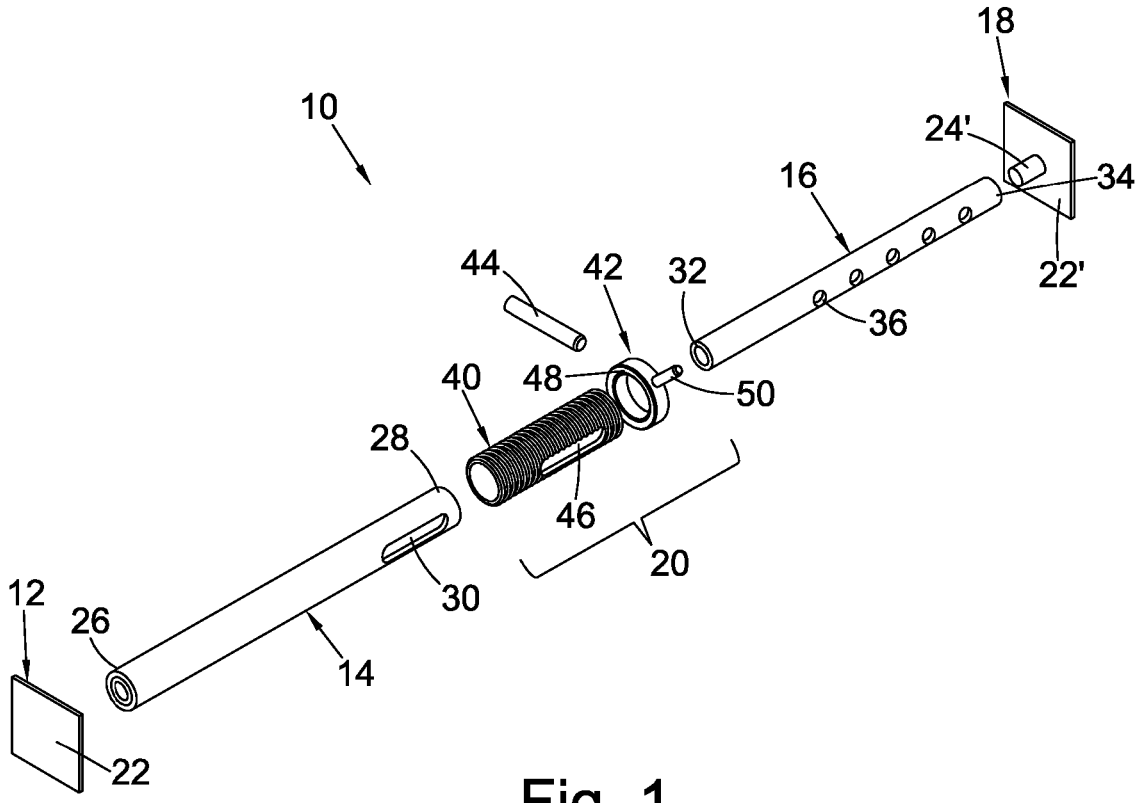
FIG. 1 shows an exploded view of a prop according to certain embodiments.

With reference to FIG. 1, a prop 10 comprises a first foot 12, a first tube 14, a second tube 16, a second foot 18, and a linear actuator 20.

The first and second feet 12, 18 each include a substantially flat plate 22, 22' and a spigot 24, 24' perpendicularly connected to the flat plate 22, 22'. The outer diameter of each spigot 24, 24' corresponds to the inner diameter of the respective first and second tubes 14, 16. In particular, the outer diameters of the spigots 24, 24' may be an interference fit with the inner diameters of the first and second tubes 14, 16. The first and second feet 12, 18 may be made from a plastics material. The plastics material may be reinforced with fibers to provide additional load bearing strength. The plastics material may be a carbon fiber reinforced plastics material. In this way, if either foot 12, 18 contacts an electrical component, such as a cable, when installed, the foot 12, 18 will electrically insulate the prop 10.

The first tube 14 comprises a loading end 26 and an actuation end 28. The loading end 26 connects to the spigot 24 of the first foot 12. In this way, an axial load is received by the loading end 26 and transferred axially through the first tube 14. The first tube 14 includes a longitudinal slot 30 extending axially and provided on opposing sides of the first tube 14 (only one slot is shown in FIG. 1). The longitudinal slot 30 is provided in the vicinity of the actuation end 28.

The second tube 16 comprises an actuation end 32 and a loading end 34. The outer diameter of the second tube 16 is smaller than the interior diameter of the first tube 14. In this way, the second tube 16 has a sliding fit with the first tube 14. The second tube 16 includes a plurality of pin sockets 36 formed by holes passing through opposing sides of the first tube 14. The pin sockets 36 are axially spaced.

The first and second tubes 14, 16 are made from a plastics material. In this way, if either tube 14, 16 contacts a stray electrical component, such as a cable, the prop 10 will be electrically insulated. This is particularly important for the tubes 14, 16 as opposed to other parts of the prop since an operator would touch the tubes to install or remove the prop 10 and any stray electrical components would likely be in the vicinity of load surfaces (e.g. trench walls). The plastics material may comprise fiber reinforcements to provide additional load bearing strength, particularly in an axial direction. The plastics material may be carbon fiber reinforced plastic.

The linear actuator 20 telescopically connects the first tube 14 to the second tube 16 for axially displacing the second tube between a retracted position and an extended position. The linear actuator 20 comprises a sleeve 40, a ring 42 and a pin 44.

The sleeve 40 has a threaded section, which is externally threaded along the entire length of the sleeve 40. The sleeve 40 is elongate and has a longitudinal slot 46 substantially the same shape and configuration as the longitudinal slot 30 of the first tube 14. The sleeve 40 has an interior diameter corresponding to the outer diameter of the first tube 14. The sleeve 40 connects to the actuation end 28 of the first tube 14. In this way, the prop 10 has a threaded section associated with the first tube 14. An annular wall 41 (FIG. 3) is provided to abut the actuation end 28 of the first tube 14 to transfer an axial load from the sleeve 40 to the first tube 14. The annular wall 41 also provides a fail-safe in case the bonding attaching the sleeve 40 to the first tube 14 fails.

Various methods of attaching the sleeve 40 to the first tube 14 may be used, for instance by welding, bonding, or using an adhesive. These attachment methods are not limiting. When attached, the longitudinal slot 30 of the first tube 14 overlays the longitudinal slot 46 of the sleeve 40 to provide a longitudinal channel through both the sleeve 40 and the first tube 14.

The ring 42 comprises a ring body 48 and a handle 50. The ring body 48 is internally threaded for threading engagement with exterior threads of the sleeve 40. The handle 50 is provided as a stub rigidly formed and integral with the ring body 48.

The pin 44 has an outer diameter corresponding to the diameter of the pin sockets 36 of the second tube 16. In particular, the pin 44 is arranged to be in sliding fit with the pin sockets 36 when assembled.

One or more of the sleeve 40, the ring 42, and the pin 44 are made from a plastics material. The plastics material may be a thermoplastics material, for instance nylon. Nylon allows threads to be cut into the surface without unacceptably compromising the strength of the linear actuator 20. In addition, nylon may be self-lubricating, which is desirable for threaded components.

The linear actuator 20 is likely to be the last part of the prop 10 to be contacted by an operator during installation and the first part of the prop 10 to be contact by an operator during removal. However, as will be appreciated from the description below, the linear actuator 20 is spaced from the loading ends 26, 34 of the first and second tubes 14, 16 when the prop 10 is in an extended configuration (see below) and thus suspended away from load surfaces (e.g. trench walls). Accordingly, the linear actuator 20 is electrically insulated by the plastic tubes 14, 16, and/or the plastic feet 12, 18 from any stray electrical components protruding from the load surfaces and which may contact the prop 10. Since the linear actuator 20 is electrically insulated from high risk electrical exposure areas, it is possible to make the linear actuator 20 from a metallic material, such as steel, to accommodate the transfer of a load between the first and second tubes 14, 16.

Figure 2:
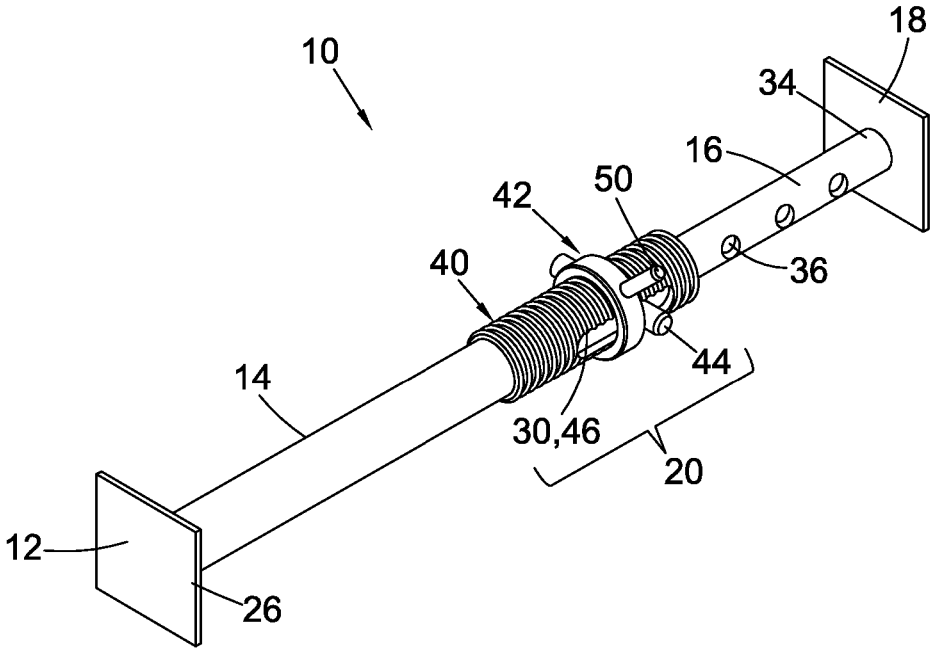
FIG. 2 shows a perspective view of the prop from FIG. 1.
Figure 3:
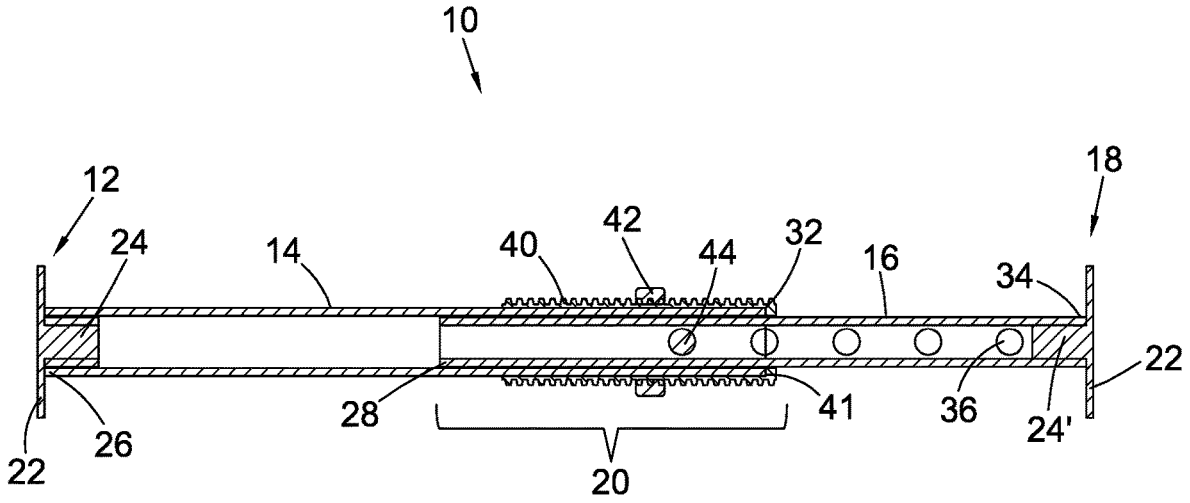
FIG. 3 shows a cross section view of an embodiment of the prop from FIG. 1.

Operation of the linear actuator 20 is described now with reference to FIGS. 2 and 3.

The pin 44 is removed and the second tube 16 is axially displaced from a stowed position to a retracted position where the feet 12, 18 are in the vicinity of load surfaces (e.g. trench walls). The pin 44 is then passed through the longitudinal slots 30, 46 and through a nearest pin socket 36. The handle 50 is turned to progress the ring 42 toward the loading end 34 of the second tube 16. The ring 42 abuts the pin 44 to displace the second tube 16 axially between the retracted position and an extended position.

Figure 4:
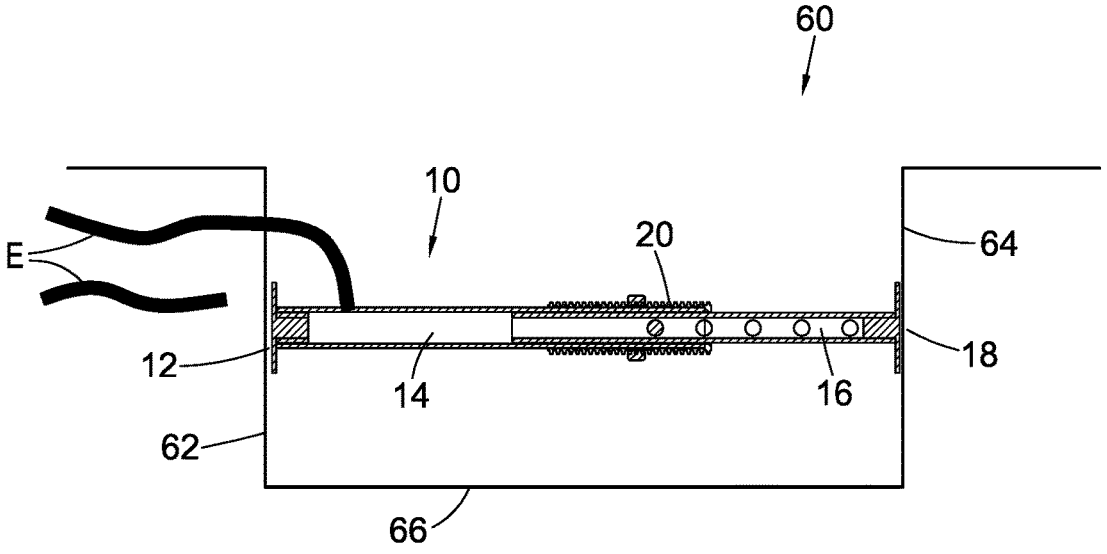
FIG. 4 shows a perspective view of the prop from FIG. 1 installed in a trench to support opposing sidewalls.

With reference to FIG. 4, in-use, the prop 10 is installed in a trench 60. The trench 60 has opposing sidewalls 62, 64, and a floor 66. The prop 10 is lowered into the trench 60 by an operator (not shown). The first foot 12 is positioned to engage one of the sidewalls 62. The linear actuator 20 is operated manually by the operator in the foregoing way to displace the second tube 16 from the retracted position to the extended position where the second foot 18 engages the opposing wall 64. The linear actuator 20 may be used to further extend the prop 10 to apply a support force against the opposing sidewalls 62, 64 to prevent them from collapsing whilst the operator performs tasks within the trench 60. The sidewalls 62, 64 thus become load surfaces and the reactive axial load is transferred through the prop 10. In particular, the axial load is received at respective loading ends 26, 34 of the first and second tubes 14, 16. The axial load is transferred through the threaded section associated with the first tube 12, provided by virtue of the sleeve 40 (FIG. 1). In turn, the load is then transferred through the ring 42 and the pin to the second tube 16.

To remove the prop 10, the reverse process is carried out. Namely, the ring 42 is turned toward the loading end 26 of the first tube 14. The load from the sidewalls 62, 64 serves to retract the second tube 16. Once loose, the pin 44 (FIG. 1) may be removed and the second tube 16 retracted fully into the first tube 14. The pin 44 may be reinstalled to a subsequent socket 36 (FIG. 1) to stow the prop 10.

Whilst the operator performs tasks in the trench 60, subterranean objects such as electrical components (E) may be disturbed and become exposed. The electrical components (E) may include stray cables, which may suffer damage when excavating the trench or during tasks performed within the trench. A stray cable is most likely to contact the feet 12, 18 or either tube 14, 16 since those components are in closest proximity to the sidewalls 62, 64. Any contact between the electrical component (E) and the feet 12, 18 or tubes 14, 16 will not result in an electrical injury to an operator touching the tubes 14, 16 or feet 12, 18 when removing the prop 10 by virtue of them being made from a plastics material.

The linear actuator 20 is spaced from the loading ends 26, 34 and is thus suspended away from the sidewalls 62, 64 and also the floor 66 and so is unlikely to come into contact with electrical components (E). Accordingly, the linear actuator 20 is electrically insulated from the loading ends 26, 34 reducing the risk of an injury to an operator. However, a plastics material, such as nylon, may be preferable to reduce the electrical injury risk further, especially since the linear actuator 20 is likely to be the first part of the prop 10 to be touched by an operator when removing the prop 10. In addition, plastics materials may be desirable to reduce the risk of corrosion.

Figure 5:
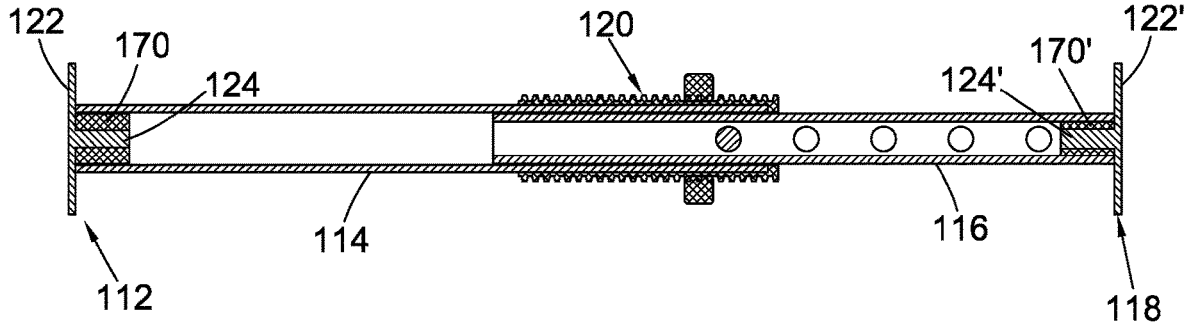
FIG. 5 shows a cross section view of a further embodiment of the prop from FIG. 1.

With reference to FIG. 5, an embodiment of the prop 110 may include alternative first and second feet 112, 118. The remaining components are substantially the same as described above and so duplicated description has been omitted. Reference signs used in this embodiment correspond to those used in the foregoing embodiment, but preceded with a '1'.

The first foot 112 includes a plate 122 and a spigot 124. The first tube 114 includes an interior surface. The first tube 114 also includes an attachment sleeve 170. The outer diameter of the attachment sleeve 170 corresponds to an inner diameter of the first tube 114. The attachment sleeve 170 is fixed to the first tube 114 by bonding. A resin or glue may be used for fixing the attachment sleeve 170 to the first tube 114. The interior surface of the attachment sleeve 170 is threaded and an exterior surface of the spigot 124 is threaded. In this way, the spigot 124 and the attachment sleeve 170 include complimentary threads. The complimentary threads enable the first foot 112 to be removably mounted to the first tube 114.

The second foot 118 includes a plate 122' and a spigot 124'. The second tube 116 includes an interior surface. The second tube 116 also includes an attachment sleeve 170'. The outer diameter of the attachment sleeve 170' corresponds to an inner diameter of the first tube 114. The attachment sleeve 170' is fixed to the second tube 116 by bonding. A resin or glue may be used for fixing the attachment sleeve 170' to the second tube 116. The interior surface of the attachment sleeve 170' is threaded and an exterior surface of the spigot 124' is threaded. In this way, the spigot 124' and the attachment sleeve 170' include complimentary threads. The complimentary threads enable the second foot 118 to be removably mounted to the second tube 116.

The first and/or second feet 112, 118, and the attachment sleeve(s) 170, 170' may comprise a plastics material. A suitable plastics material is a thermoplastic, and may include nylon in order to accommodate cutting the threads. The first and/or second feet 112, 118 and/or the attachment sleeve(s) 170, 170' may be manufactured by compression or injection molding. Alternatively, the first and/or second feet 112, 118, and/or the attachment sleeve(s) 170, 170' may comprise a metallic material. A suitable metallic material includes mild steel.

The invention claimed is:

1. A prop comprising a first tube and a second tube, the first tube being telescopically connected to the second tube for axially displacing the second tube between a retracted position and an extended position, the first and second tubes each comprising a loading end for receiving an axial load from opposing load surfaces in the extended position, wherein the first tube and the second tube are made from a plastics material, the prop further comprising a linear actuator to connect telescopically the first and second tubes, wherein the linear actuator is spaced from the loading ends of the first and second tubes when the prop is in the extended position, the first and second tubes electrically insulating the linear actuator from the respective loading ends, wherein the linear actuator comprises a threaded section associated with the first tube, a ring threadingly engaged with the threaded section, and a pin coupled to the second tube for transferring the axial load between the second tube and the ring, wherein the linear actuator comprises a sleeve attached to the first tube, the sleeve comprising the threaded section.

2. The prop of claim 1, further comprising a first foot connected to the loading end of the first tube for engaging a load surface and a second foot connected to the second tube for engaging an opposing load surface, wherein the first and second feet are made from a plastics material.

3. The prop of claim 2, wherein the first foot and/or the second foot comprises a base plate and a spigot extending therefrom, the spigot and the respective first tube or second tube comprising complimentary threads.

4. The prop of claim 3, wherein the first tube and/or the second tube comprises an attachment sleeve fixed to an interior surface thereof, the attachment sleeve including the threads.

5. The prop of claim 1, wherein the plastics material of one or more of the first tube, the second tube, the first foot, and the second foot comprises fiber reinforcements.

6. The prop of claim 5, wherein the fiber reinforcements comprise carbon.

7. The prop of claim 1, wherein the ring comprises a handle integrally formed therewith.

8. The prop of claim 1, wherein the sleeve comprises an annular wall to abut an end of the first tube opposite to the loading end.

9. The prop of claim 1, wherein one or more of the sleeve, the ring, and the pin are made from a plastics material.

10. The prop of claim 1, wherein one or more of the plastics materials is a thermoplastic.

11. The prop of claim 10, wherein the thermoplastic is nylon.

12. The prop of claim 1, wherein the axial load is transferred through the plastics material.

* * * * *